US006330969B1

(12) United States Patent
Villaraut

(10) Patent No.: US 6,330,969 B1
(45) Date of Patent: Dec. 18, 2001

(54) CLEANER CALCULATOR

(76) Inventor: Sandro Villaraut, 401 Center St., Garwood, NJ (US) 07027

( * ) Notice: Subject to any disclaimer, the term of this patent is extended or adjusted under 35 U.S.C. 154(b) by 0 days.

(21) Appl. No.: 09/614,292

(22) Filed: Jul. 12, 2000

Related U.S. Application Data

(60) Provisional application No. 60/143,376, filed on Jul. 12, 1999.

(51) Int. Cl.[7] ..... G06C 3/00
(52) U.S. Cl. ..... 235/64.7; 235/375
(58) Field of Search ..... 235/375, 64.7

(56) References Cited

U.S. PATENT DOCUMENTS 3,730,064 * 5/1973 Peterson ..... 235/64.7

* cited by examiner

*Primary Examiner*—Harold I. Pitts

(74) *Attorney, Agent, or Firm*—Law Offices of Royal W. Craig

(57) ABSTRACT

A cleaner calculator for maintaining a count representative of the number of times that a garment has been worn between dry cleanings. The cleaner calculator includes a tag stem with an attachment section for hanging the cleaner calculator, a promotional label area for promoting the dry cleaner, and a base section. The cleaner calculator also includes a turn-dial indicator rotatably mounted on the base section of the tag stem. An indexing mechanism provides an indexed engagement between the turn-dial indicator and the base section of the tag stem. Count indicia are provided with numbers ranging from three to five as determined by the specific dry cleaner. The count indicia indicate the number of times a piece of clothing has been worn between dry cleanings, and the count indicia can be incremented each time the garment is worn by rotating the turn-dial.

In both cases, the device provides a simple, inexpensive and convenient accessory to count the number of times a piece of clothing has been worn between dry cleanings. The cleaner calculator can be hung on a standard clothes hanger, or embedded in the clothes hanger itself for distribution therewith.

17 Claims, 6 Drawing Sheets

CLEANER CALCULATOR

CROSS-REFERENCE TO RELATED APPLICATIONS

The present application derives priority from Provisional Patent Application No. 60/143,376 filed on Jul. 12, 1999.

BACKGROUND OF THE INVENTION

1. Field of the Invention

The present invention relates to dry cleaning accessories and, more particularly, to a promotional gift-with-purchase to the customers of dry cleaners to allow them to keep track of the number of times a piece of clothing has been worn between visits to their dry cleaner.

2. Description of the Background

The great majority of consumers take delicate linens and clothing to a professional dry cleaner when it is time to be cleaned. However, determining when a given article of clothing needs to be dry cleaned is not always a straightforward proposition. Most clothing can be worn a few times before it is ready for the dry cleaners, and most individuals make a purely subjective determination as to when it is ready. Others try to brings some objectivity to task. For instance, some will take an item of clothing to the dry cleaners each time it is worn. Still others hang their clothing in their closet in a certain order (as in a queue) so as to indicate when each article was last used or cleaned. Presently, there is no economical and reliable device on the market to indicate that a piece of clothing has been worn a specified number of times and is ready for the dry cleaners.

The above presents an excellent promotional opportunity for dry cleaners. Presently, dry cleaners advertise heavily on their boxes and packaging. Unfortunately, most boxes and/or dry cleaning packaging is discarded without ever being read. Of course, once discarded, the promotional value is lost.

It would be greatly advantageous to provide a simple and convenient device to assist in keeping track of the number of times a piece of clothing has been worn to determine when it is ready for the dry cleaners. It would also be of great competitive advantage to provide the above-described device as economically as possible so that dry cleaners can distribute it as a gift-with-purchase thereby insuring that the promotional value of the print advertising, lasts until the next return to the dry cleaners.

SUMMARY OF THE INVENTION

In accordance with the above, it is an object of the present invention to provide a simple, inexpensive and convenient accessory to count the number of times a piece of clothing has been worn between dry cleanings.

It is another object to provide a cleaner counter with the above-described qualities and which is adapted to be hung on a standard clothes hanger.

It is still another object to provide alternate embodiments such as a cleaner counter counter that is embedded in the clothes hanger itself for distribution therewith.

According to the present invention, the above-described and other objects are accomplished by providing a cleaner calculator for maintaining the count. The cleaner calculator includes a tag stem with an attachment section for hanging the cleaner calculator, a promotional label area for promoting the dry cleaner, and a base section. The cleaner calculator also includes a turn dial indicator rotatably mounted on the base section of the tag stem. An indexing mechanism provides an indexed engagement between the turn dial indicator and the base section of the tat stem. Count indicia are provided with numbers ranging from three to five as determined by the specific dry cleaner. The count indicia indicate the number of times a piece of clothing has been worn between dry cleanings. In this manner, the turn dial indicator can be rotatably incremented each time the garment is worn, and the cleaner calculator used to count the number of wearings between dry cleanings to determine when it the garment is ready to be returned to the dry cleaner.

An alternate embodiment is shown in which the turn dial indicator is rotatably embedded in a clothes hanger, the clothes hanger thereby taking the place of the tag stem.

BRIEF DESCRIPTION OF THE DRAWINGS

Other objects, features, and advantages of the present invention will become more apparent from the following, detailed description of preferred embodiments and certain modifications thereof when taken together with the accompanying drawings in which.

DETAILED DESCRIPTION OF THE PREFERRED EMBODIMENTS

Figure 1:
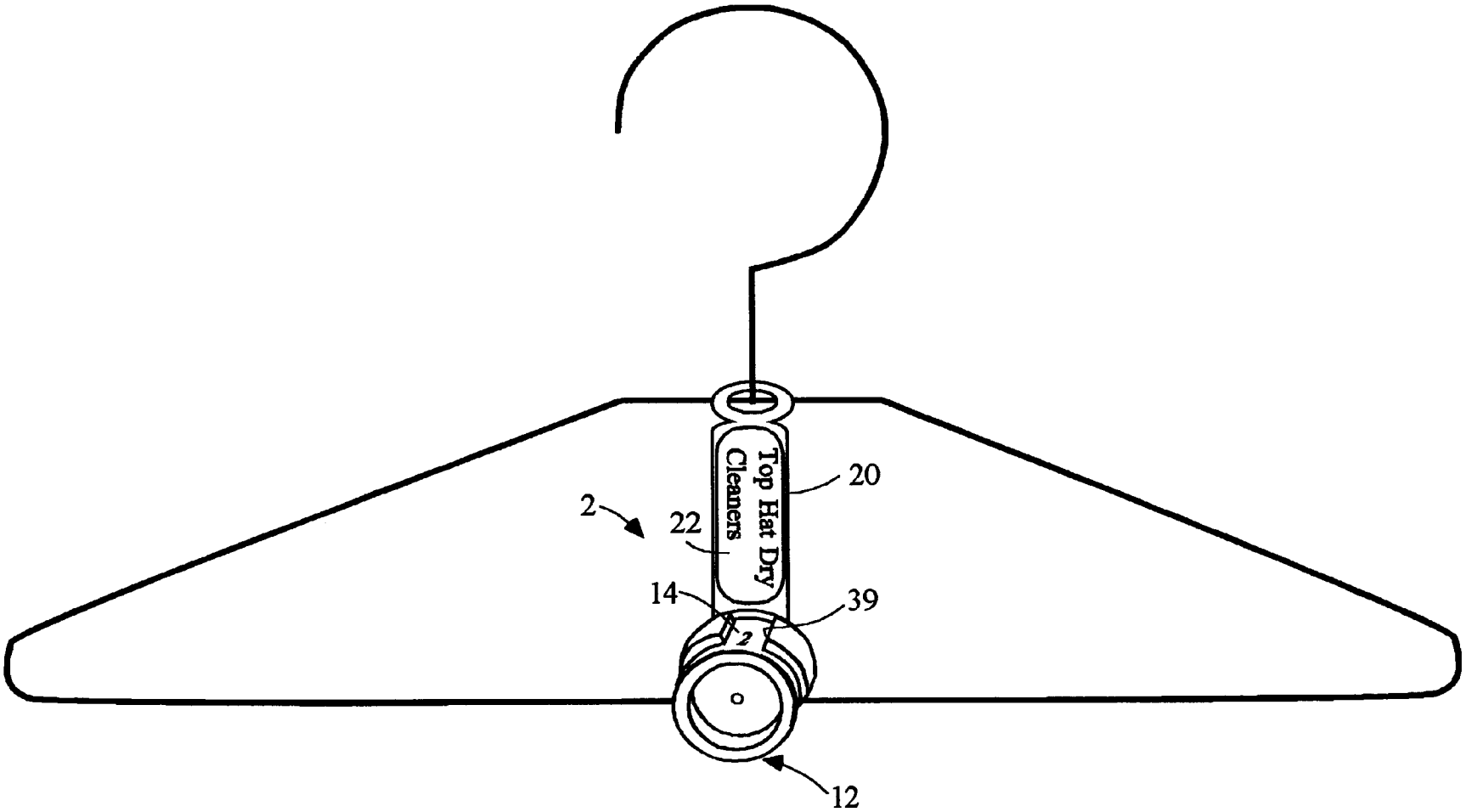
FIG. 1 is a perspective view of the cleaner calculator 2 according to one embodiment of the present invention.

FIG. 1 is a perspective view of the cleaner calculator 2 according to one embodiment of the present invention. The cleaner calculator 2 generally comprises a turn-dial indicator 12 that is rotatably mounted on a tag stem 20. Tag stem 20 may be conveniently attached to a conventional clothes hanger as will be described and preferably includes a promotional label area 22. The turn-dial indicator 12 is generally cylindrical with a peripheral viewing area defined by a plurality of radial counting indicia 14. In the present embodiment, the indicia 14 of the view area contain the numbers 0 through 4 to designate the number of times the piece of clothing, on that hanger has been worn between dry cleanings. The turn-dial indicator 12 may be manually rotated by thumb and forefinger to select one of the plurality of counting indicia 14.

Figure 2:
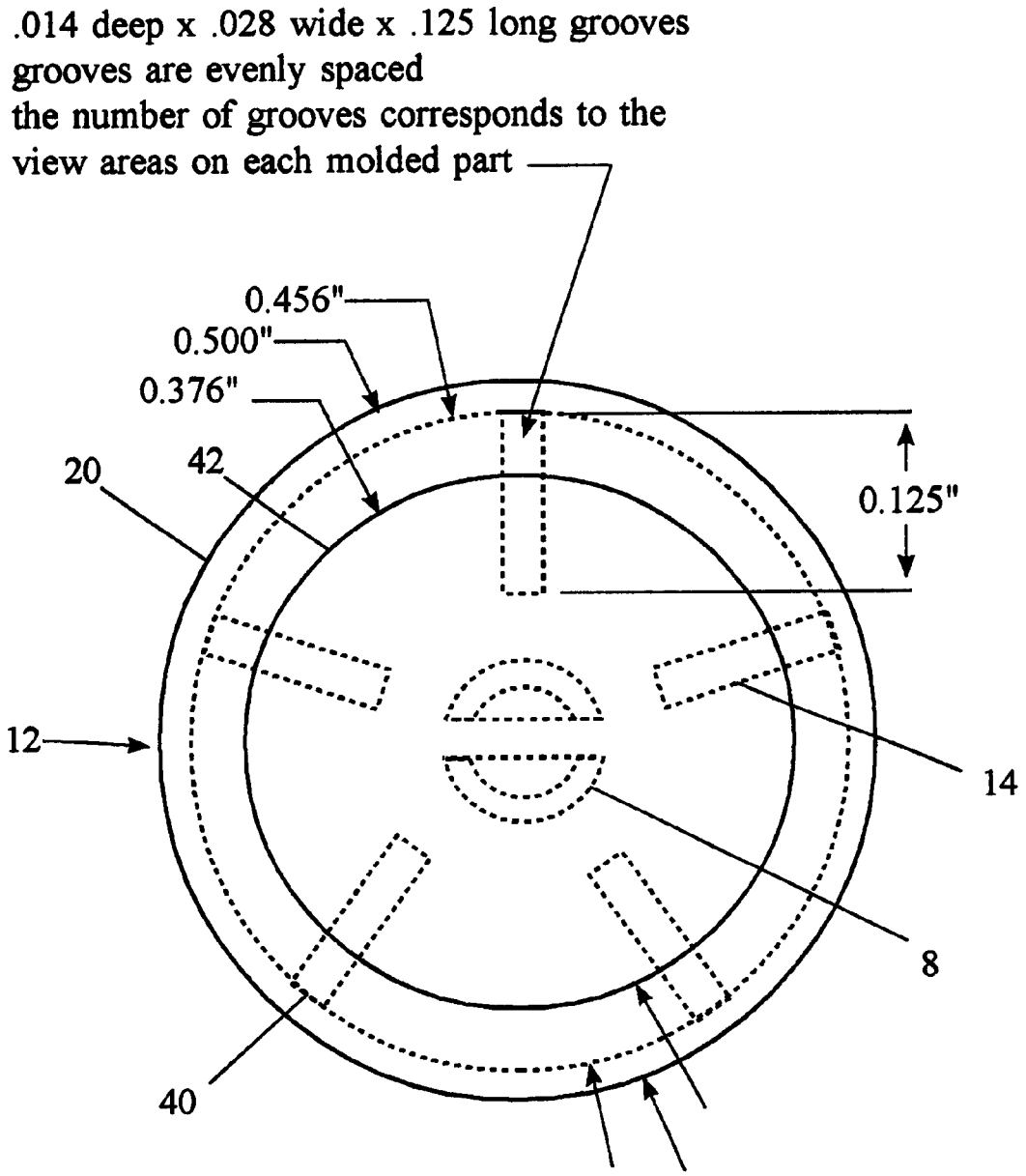
FIG. 2 is a front view of the turn dial indicator core 12 as used in the cleaner calculator 2 of FIG. 1.

FIG. 2 is a front view of the turn-dial indicator 12 with a suitable yet exemplary set of dimensions indicated thereon. Turn-dial indicator 12 is formed as a generally annular rim and can be molded from low-density polyethylene or other suitable plastic. The closed (far) end of turn-dial indicator 12 is provided with a plurality of notches 40 protruding inward (shown in dotted lines). The notches 40 are evenly and axially spaced about a resilient detent fitting 42 which rotatably anchors the turn-dial indicator 12 oil the tag stem 20. The number of notches 40 correspond to the number of count indicia 14 (see FIGS. 1 & 2) around the peripheral viewing area, and there may be three to five or more depending upon the preference of the dry cleaner. In the illustrated embodiment, each count indicia 14 (for example, each of numbers 0 through 4) in the view area are centered over the notches 40. The count indicia 14 may appear on one conventional adhesive peel-off label adhered around 360°, or on a plurality of discrete labels such as 14 shown in Fit. 2. The forward cylindrical portion 13 and rim of turn-dial indicator 12 is used for manually setting the count.

Figure 3:
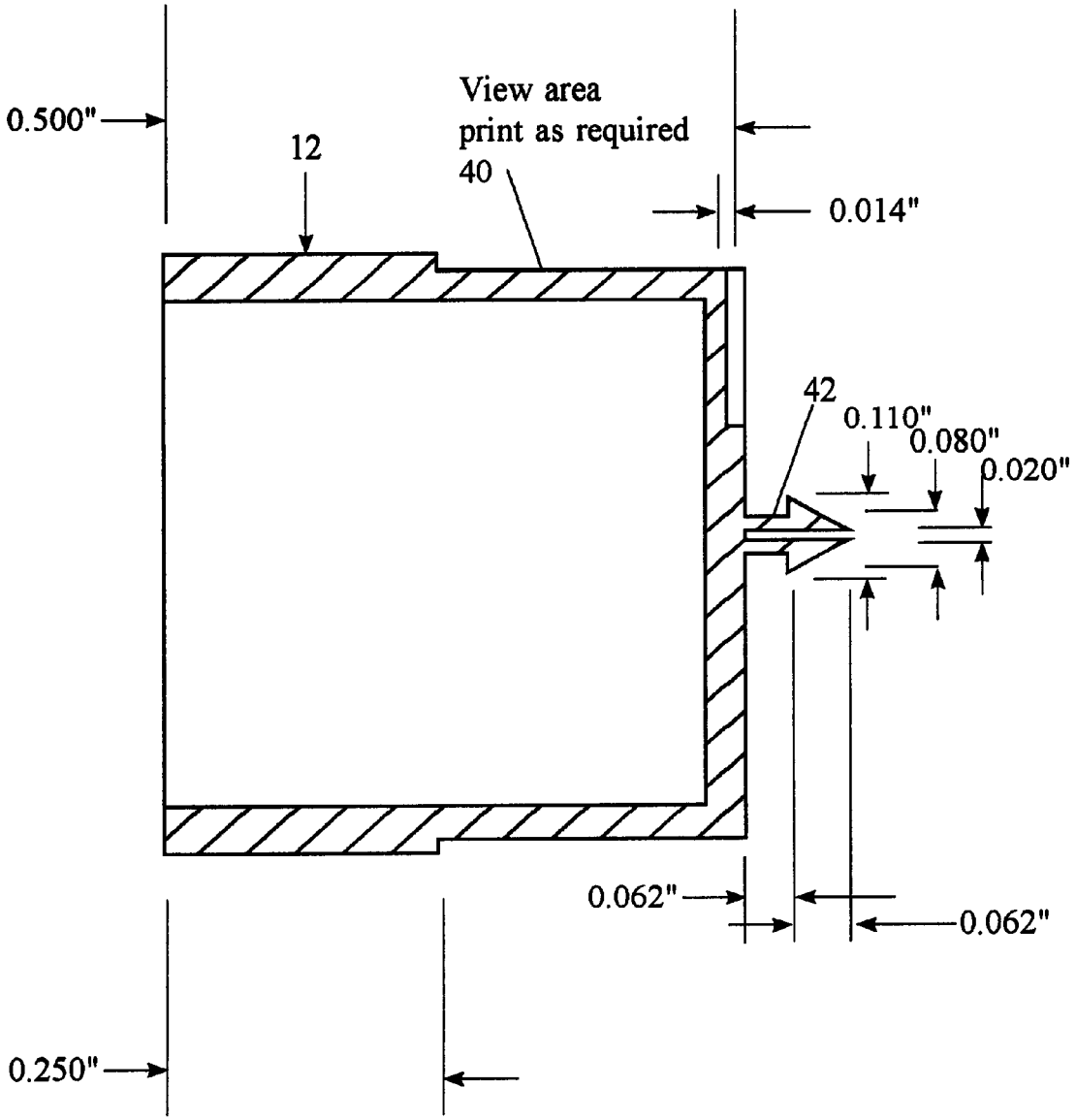
FIG. 3 is a side view of the turn dial indicator core 12 showing the resilient detent fitting 42 for locking into the tag stem 20.

FIG. 3 is a side cross-section of the turn-dial indicator 12 with a suitable yet exemplary set of dimensions indicated thereon. FIG. 3 shows the resilient detent fitting 42 for locking into the tag stem 20. Detent fitting 42 is an integrally molded pair of protruding spaced prongs each having a distal overhanging catch. The axial notches 40 are indexed to a protruding rib on the tag stem 20 as will be described. The printed view area as shown in FIG. 3 is displayed through a view window in the base of tag stem 20 as will be described. The cylindrical length of the turn-dial indicator 12 is divided into two tiers having a stepped diameter the step serving to seat the smaller-diameter portion inside the base of tag stem 20 (see FIG. 1 ). The larger diameter portion 13 of the cylindrical length of the turn-dial indicator 12 is used for manually setting the turn-dial indicator 12 to a selected one of the plurality of counting indicia 14 spaced around the smaller diameter portion.

Figure 4:
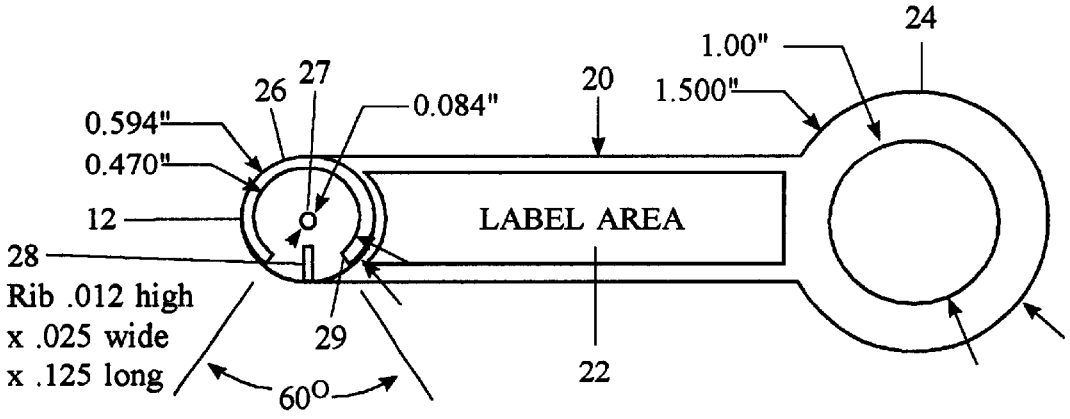
FIG. 4 is a front view of the tag stem 20.

FIG. 4 is a front view of the tag stem 20 with a suitable yet exemplary set of dimensions indicated thereon. Tag stem 20 is formed with three distinct sections. The first section is all attachment section 24 that allows tag stem 20 to be conveniently attached to a conventional clothes hanger. Here the illustrated attachment section 24 is formed as a collar that can be slipped over the neck of a hanger. However, alternate attachment sections may be formed to facilitate different means of attachment (as will be described). In any such embodiment the attachment section 24 of tag stem 20 is internally joined to promotional label area 22 and this in turn is joined to a cupped base section 26 for mounting the turn-dial indicator 12.

The label area 22 is sized to allow attachment of an adhesive promotional label. The label preferably includes print advertising for tile dry cleaner inclusive of the dry cleaner's name, address, and telephone number. The label may, optionally indicate the date upon which a dry cleaning was performed.

Base section 26 is formed as a circular hub with a central hole 27 for receiving the resilient prong fitting 42 of turn-dial indicator 12. Base section 26 preferably has a raised peripheral guide wall 29 to provide rotational stability for the turn-dial indicator 12. Base section 26 also has an upwardly protruding rib 28 formed integrally therein for indexing cooperation with the notches 40 of the turn-dial indicator 12.

Figure 5:
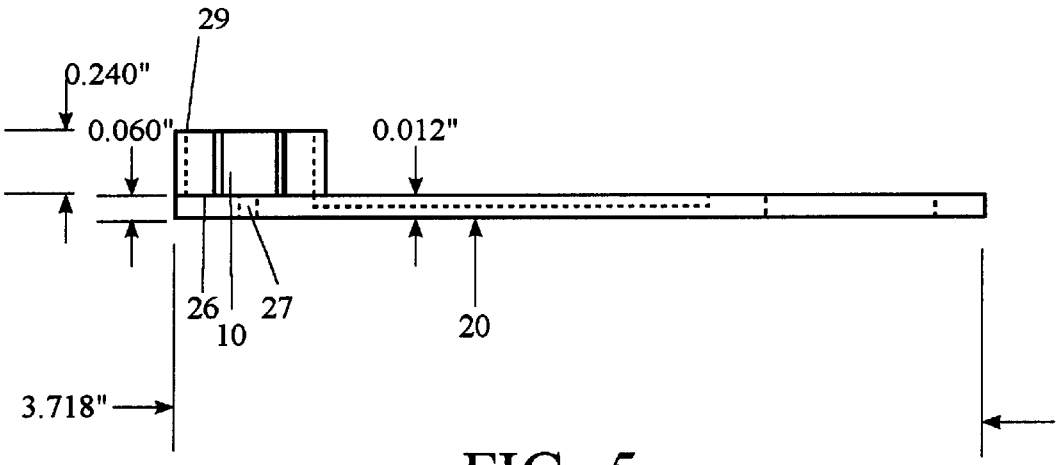
FIG. 5 is a side cross-section of the tag stem 20 which illustrates the peripheral guide wall 29 and central hole 27 of base section 26.

FIG. 5 is a side cross-section of the tag stem 20 with loop attachment 24, which illustrates the peripheral guide wall 29 and central hole 27 of base section 26. The peripheral guide wall 29 is interrupted briefly to form a viewing windows 39 through which the dry clean count of indicia 14 on the turn-dial indicator 12 remains visible. The resilient prong fitting 42 of turn-dial indicator 12 attaches to the base section 26 in the central hole 27, and the upwardly protruding rib 28 in base section 26 engages the notches 40 one-by-one as the turn-dial indicator 12 is turned, thereby providing an indexed count. The central count indicia 14 within the view area of the turn-dial indicator 12 remains visible through the window 39.

In general use, each cleaner calculator 2 is intended to be distributed as a gift-with-purchase and one may be attached and given out with each and every hanger. This way, the customer has one for each dry-cleaned garment. The dry cleaner attaches their own promotional label to label area 22 at the time that the customer picks up their clean clothes. The tag stem 20 with label is then attached to a hanger. The turn-dial indicator 12 is inserted into the tar stem 20 and is set initially at zero. Each time the customer is finished wearing the garment, the garment is returned to the original hanger and the turn-dial indicator 12 is rotated to increment the count indicia 14 by one. This way, the cleaner calculator 2 keeps a running, count of the number of times the garment has been worn between dry cleanings. The customer's use and reliance on the cleaner calculator 2 ensures almost daily exposure to the print advertising on label area 22, and the promotional value of the advertising lasts for so long as the dry cleaner's promotional label in label area 22 resides in their customer's closet.

Figure 6:
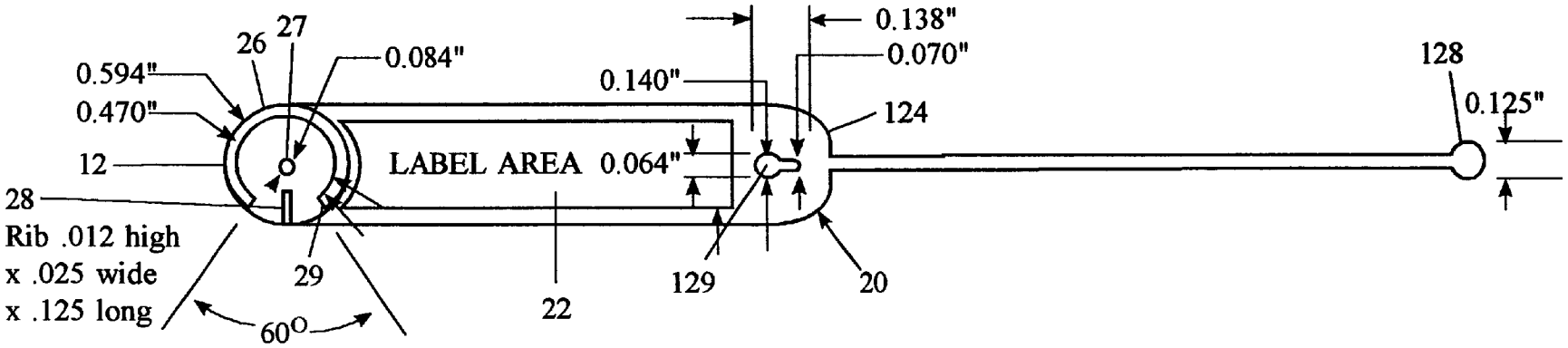
FIG. 6 is a front view of an alternate embodiment of tag stem 20 with a different attachment section 124.

FIG. 6 is a front view of an alternate embodiment of a tag stem 120 with a suitable yet exemplary set of dimensions indicated thereon. This embodiment 120 employs a different attachment section 124. Rather than circular collar, the illustrated attachment section 124 is formed as a slip tie extension for looping attachment to the hanger in accordance with the present invention. The distal end of the slip tie extension 124 is formed with a bulb 128 that may be flexed around and slipped into a small yoke hole 129 cut just above the label area 22.

Figure 7:
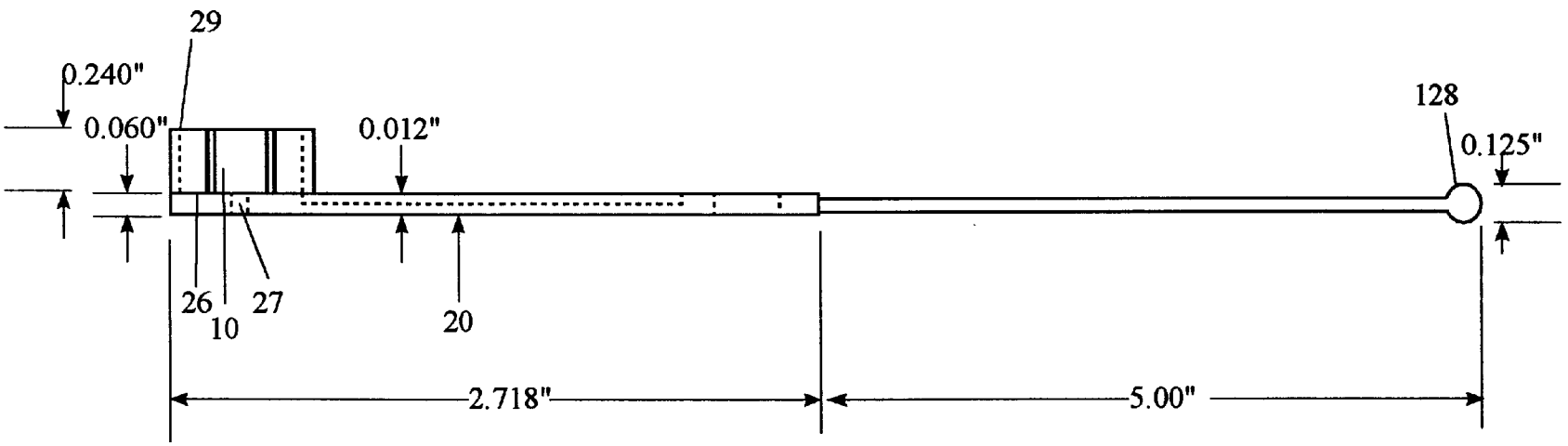
FIG. 7 is a side cross-section of the tag stem 20 with slip-tie attachment, which illustrates the peripheral guide wall 29 and central hole 27 of base section 26.

FIG. 7 is a side cross-section of the tag stem 120 of FIG. 6 with slip tie extension 124, also showing the peripheral guide wall 29 and central hole 27 of base section 26.

The very same turn-dial indicator 12 as in FIGS. 1–5 may be attached to the base section 26 by resilient prong fitting 42, the same plurality of inward notches 40 indexing turn-dial indicator 12 against rib 128 in the base section 26. The selected indicia 14 of the turn-dial indicator 12 remains visible through window 39 in base section 26.

Figure 8:
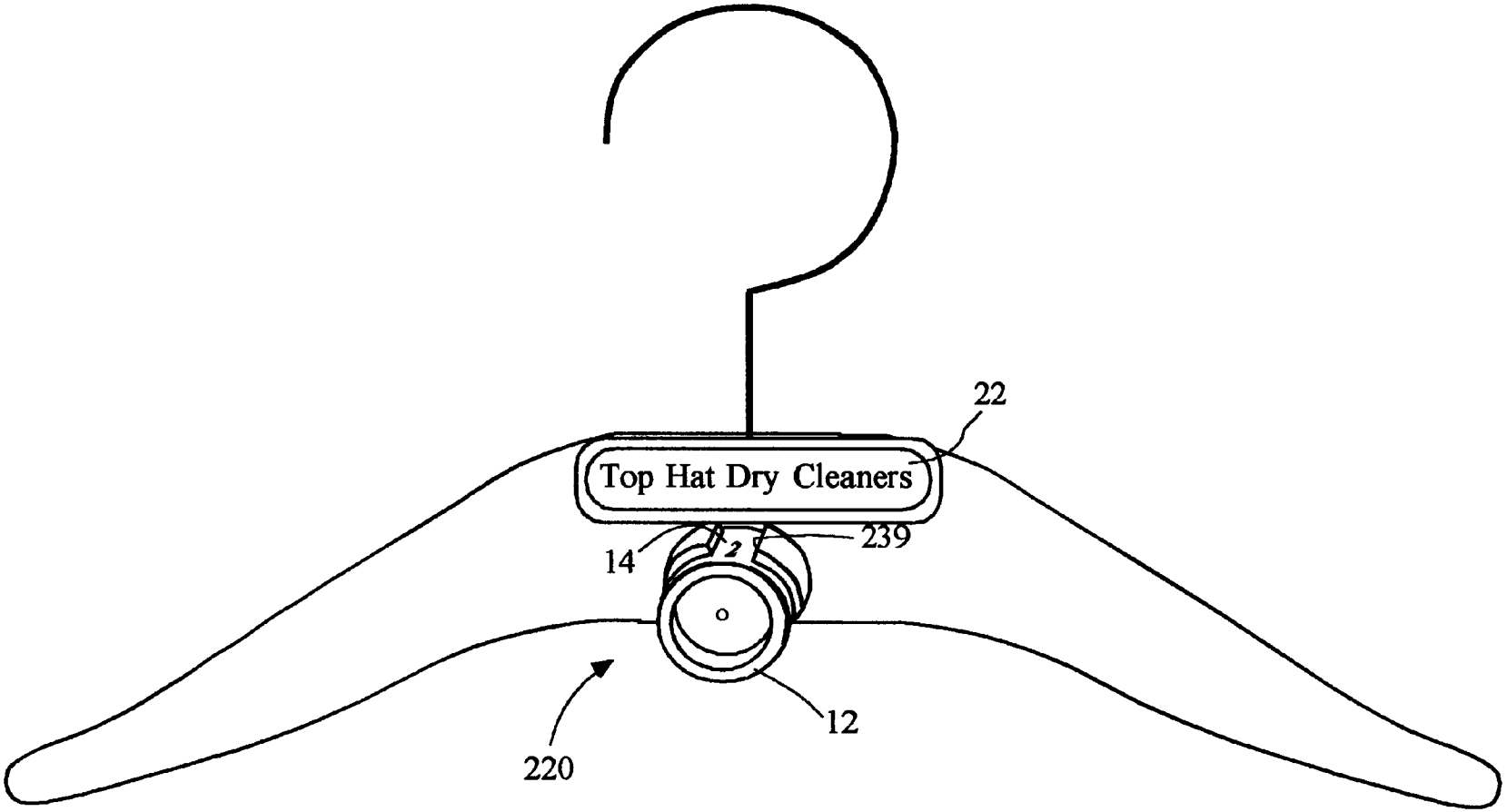
FIG. 8 is a front perspective view of yet another alternate embodiment of the cleaner calculator with base section 220 and label area 22 integrally molded into the breast of an otherwise conventional plastic clothes hanger.

FIG. 8 is a front perspective view of yet another alternate embodiment of the cleaner calculator which illustrates that a base section 220 and label area 22 can be integrally molded into the breast of an otherwise conventional plastic clothes hanger to eliminate the need for a separate tag stem. The very same turn-dial indicator 12 as in FIGS. 1–5 may be attached to the base section 220 by resilient prong fitting 42, and the same plurality of inward notches 40 (obscured) will index turn-dial indicator 12 against the rib (obscured) in the base section 220. The selected indicia 14 of the turn-dial indicator 12 remain visible through window 239 in base section 220.

Having, now fully set forth the preferred embodiments and certain modifications of the concept underlying the present invention, various other embodiments as well as certain variations and modifications of the embodiments wherein shown and described will obviously occur to those skilled in the art upon becoming familiar with said underlying concept.

I claim:

1. A cleaner calculator for maintaining a dry-cleaning count, comprising:

an integral tag stem having an attachment section for hanging the cleaner calculator, a promotional label area, and a base section, a turn-dial indicator rotatably mounted on the base section of the tag stem;

an indexing mechanism for indexed engagement of the turn-dial indicator with the base section of the tag stem;

whereby said cleaner calculator can be used to count the number of times a piece of clothing has been worn between dry cleanings to determine when it is ready to be returned to the dry cleaner.

2. The cleaner calculator according to claim 1, wherein said turn-dial indicator further comprises a hollow cylindrical section closed at one end.

3. The cleaner calculator according to claim 2, wherein the indexing mechanism is for indexed engagement of the turn-dial indicator with the base section and further comprises a plurality of axial notches in the closed end of the turn-dial indicator for cooperation with a raised rib on the base section.

4. The cleaner calculator according to claim 3, wherein the notches are evenly and axially spaced about a protruding detent prong fitting that rotatably anchors the turn-dial indicator on the base of the tag stem.

5. The cleaner calculator according to claim 3, wherein the turn dial indicator is defined by a plurality of count indicia spaced around the outer periphery, said count indicia indicating the incremental usage between dry cleanings.

6. The cleaner calculator according to claim 5, wherein the base section of the internal tag stem further comprises a raised wall for seating, and rotatably (guiding) the turn dial indicator, said raised wall being interrupted by a viewing window for viewing the count indicia on the turn dial indicator.

7. The cleaner calculator according to claim 6, wherein the number of said notches corresponds to the plurality of count indicia on the turn dial indicator.

8. The cleaner calculator according to claim 4, wherein the protruding detent fitting further comprises integrally molded protruding prongs each having a distal overhanging catch.

9. The cleaner calculator according to claim 2, wherein the hollow cylindrical section of the turn dial indicator is formed in two tiers of stepped diameter.

10. The cleaner calculator according to claim 9, wherein the base section of the tag stem further comprises an annular raised wall that is interrupted to form said viewing window.

11. The cleaner calculator according to claim 10, wherein the smaller-diameter tier of the hollow cylindrical section of the turn dial indicator is rotatably seated inside the annular wall of the base section of the tag stem.

12. The cleaner calculator according to claim 11, wherein the larger-diameter tier of the hollow cylindrical section of the turn dial indicator is used for manually setting the turn-dial indicator to a selected one of the plurality of counting indicia.

13. The cleaner calculator according to claim 12, wherein the label section is adapted for attachment by a dry cleaner of their own promotional label to ensures promotional exposure.

14. The cleaner calculator according to claim 1, wherein the attachment section of the integral tag stem further comprises a hook for hanging the cleaner calculator.

15. The cleaner calculator according to claim 1, wherein the attachment section of the integral tag stem further comprises a loop for hanging the cleaner calculator.

16. The cleaner calculator according to claim 1, wherein the attachment section of the integral tag stem further comprises a slip tie for hanging the cleaner calculator.

17. A cleaner calculator for maintaining a count, comprising:

a turn-dial indicator rotatably mounted on a conventional clothes hanger;

an indexing mechanism for indexed engagement of the turn-dial indicator with the clothes hanger;

whereby said cleaner calculator can be used to count the number of times a piece of clothing has been worn between dry cleanings to determine when it is ready to be returned to the dry cleaner.

* * * * *